US009033738B2

(12) United States Patent
Wang et al.

(10) Patent No.: US 9,033,738 B2
(45) Date of Patent: May 19, 2015

(54) CABLE ASSEMBLY WITH IMPROVED TERMINAL STRUCTURE

(71) Applicant: Hon Hai Precision Industry Co., Ltd., New Taipei (TW)

(72) Inventors: Chien-Chiung Wang, New Taipei (TW); Jerry Wu, Irvine, CA (US); Jun Chen, Kunshan (CN); Fan-Bo Meng, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 135 days.

(21) Appl. No.: 13/907,787

(22) Filed: May 31, 2013

(65) Prior Publication Data

US 2013/0323970 A1 Dec. 5, 2013

(30) Foreign Application Priority Data

May 31, 2012 (CN) ..... 2012 1 0174182

(51) Int. Cl.

| | |
|---|---|
| ***H01R 13/648*** | (2006.01) |
| ***H01R 13/658*** | (2011.01) |
| ***H01R 13/6471*** | (2011.01) |
| *H01R 24/62* | (2011.01) |
| *H01R 107/00* | (2006.01) |

(52) U.S. Cl.

CPC ..... *H01R 13/65807* (2013.01); *H01R 13/6471* (2013.01); *H01R 24/62* (2013.01); *H01R 2107/00* (2013.01)

(58) Field of Classification Search

CPC ..... H01R 13/65807; H01R 13/6471; H01R 24/62; H01R 2107/00

USPC ..... 439/92, 108, 607.05–607.14

See application file for complete search history.

(56) References Cited

U.S. PATENT DOCUMENTS

| | | | | |
|---|---|---|---|---|
| 6,331,120 | B1 | 12/2001 | Clement | |
| 8,348,700 | B1 * | 1/2013 | Chiang | 439/607.08 |
| 8,465,302 | B2 * | 6/2013 | Regnier et al. | 439/108 |
| 8,597,052 | B2 * | 12/2013 | Davis et al. | 439/607.08 |
| 8,894,442 | B2 * | 11/2014 | McClellan et al. | 439/607.05 |

FOREIGN PATENT DOCUMENTS

| | | |
|---|---|---|
| CN | 201438577 | 4/2010 |
| CN | 201562832 U | 8/2010 |
| CN | 201570638 | 9/2010 |
| CN | 201789115 | 4/2011 |
| CN | 202042690 U | 11/2011 |
| JP | 2012508958 A | 4/2012 |

* cited by examiner

*Primary Examiner* — Khiem Nguyen

(74) *Attorney, Agent, or Firm* — Wei Te Chung; Ming Chieh Chang

(57) ABSTRACT

A cable assembly comprises: an insulative housing and a terminal module assembled to a rear end of the insulative housing. The terminal module comprises a plurality of pairs of differential signal terminals and a plurality of grounding terminals arranged long a widthwise direction thereof. Each of terminal defining a mating portion, a body portion and a soldering portion. Mating portions of the signal and grounding terminals are located on a row, body portions and soldering portions of the signal and grounding terminals are located on two rows. There are at least one grounding terminal is intervened between two pairs of differential signal terminals to totally space apart the body portions and soldering portions of two adjacent pairs of differential signal terminals located on two rows.

13 Claims, 10 Drawing Sheets

CABLE ASSEMBLY WITH IMPROVED TERMINAL STRUCTURE

FIELD OF THE INVENTION

The present invention generally relates to a cable assembly, more specifically to a cable assembly with high signal transmitting rate.

DESCRIPTION OF PRIOR ART

China Pat. No. 201438577U issued to Wu on Apr. 14, 2010 discloses a cable assembly comprising an insulative housing, a metallic shell shielding the insulative housing, a plurality of terminals received into the insulative housing, a cable electrically connected to the plurality of terminals, and a cover surrounding the metallic shell. The plurality of terminals comprises four pairs of differential signal terminals and several grounding terminals spaced apart two adjacent pairs of differential signal terminals. One pair of differential signal terminals can be used to transmit bi-directional hybrid signal. Three pairs of differential signals terminals can be used to transmit uncompressed video signal.

The plurality of terminals have a plurality of mating portions arranged into a row and a plurality of soldering portions arranged into an upper and a lower rows. As rear soldering portions of two adjacent pairs of differential signal terminals are located on different rows, so a grounding terminal can not completely space rear soldering portions of two adjacent pairs of differential signal terminals in a vertical direction. Thus, signal transmission between two adjacent pairs of differential signal terminals will be affected to each other. As a result, near-end crosstalk (NEXT) will be occurred during signal transmission of the cable assembly.

An improved cable assembly overcoming shortages of existing technology is needed.

SUMMARY OF THE INVENTION

Accordingly, an object of the present invention is to provide a cable assembly with improved signal transmitting performance.

In order to achieve the above-mentioned object, a cable assembly comprises: an insulative housing and a plurality of terminals assembled to the insulative housing. The plurality of terminals comprises several pairs of differential signal terminals and at least one grounding terminal intervened between each of two adjacent pairs of differential signal terminals along a transversal direction. Each of terminal defines a front mating portion, a rear soldering portion and a body portion connecting with the mating portion and the soldering portion. The front mating portions of the plurality of terminals are located on a row, the body portions and rear soldering portions of the plurality of terminals respectively are located on two rows along an up-to-down direction. And body portions and rear soldering portions of each differential signal terminals are located on two located on two upper and lower rows. Wherein there is only one grounding terminal intervened between two adjacent pairs of differential signal terminals, the grounding terminal defines an extending portion extending along a vertical direction to totally spaced apart the body portions and rear soldering portions of two adjacent pairs of differential signal terminals located on two upper and lower rows along a transversal direction.

Other objects, features and advantages of the invention will be apparent from the following detailed description taken in connection with the accompanying drawings.

DETAILED DESCRIPTION OF PREFERRED EMBODIMENTS

Figure 1:
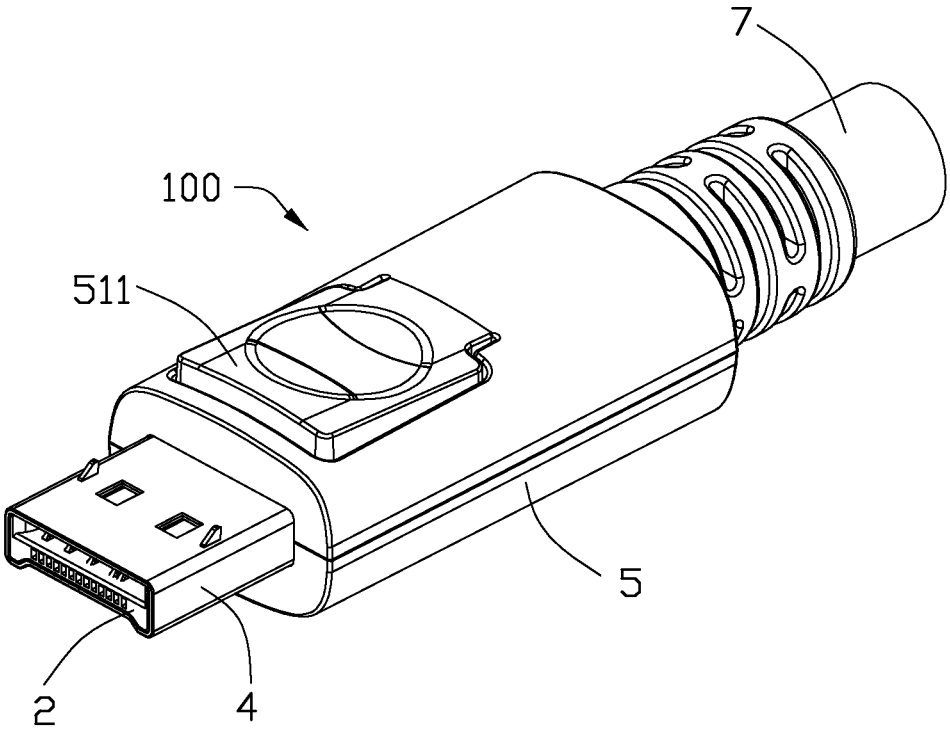
FIG. 1 is a perspective view of a cable assembly in accordance with the present invention.

Reference will now be made to the drawing figures to describe the present invention in detail.

FIG. 1 illustrates perspective view of a cable assembly 100 made in accordance with the present invention. Referring to FIGS. 2 to 5, the cable assembly 100 comprises an insulative housing 2, a terminal module 3 assembled to the insulative housing 2, a metallic shell 4 shielding the insulative housing 2 and the terminal module 3, an insulative cover surrounding the metallic shell 4, and a cable set 7 electrically connected to the terminal module 3.

Figure 2:
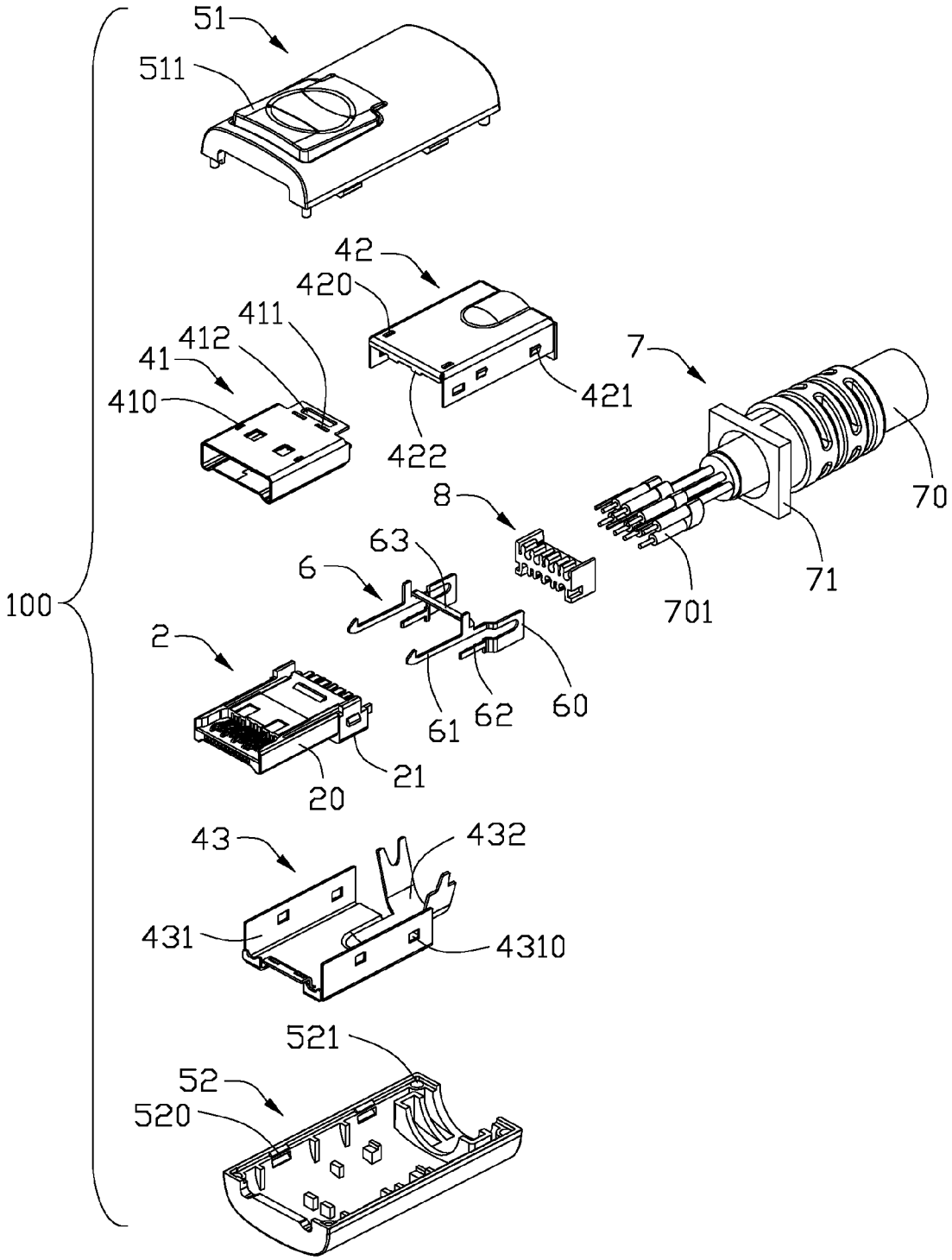
FIG. 2 is an exploded, perspective view of FIG. 1.
Figure 3:
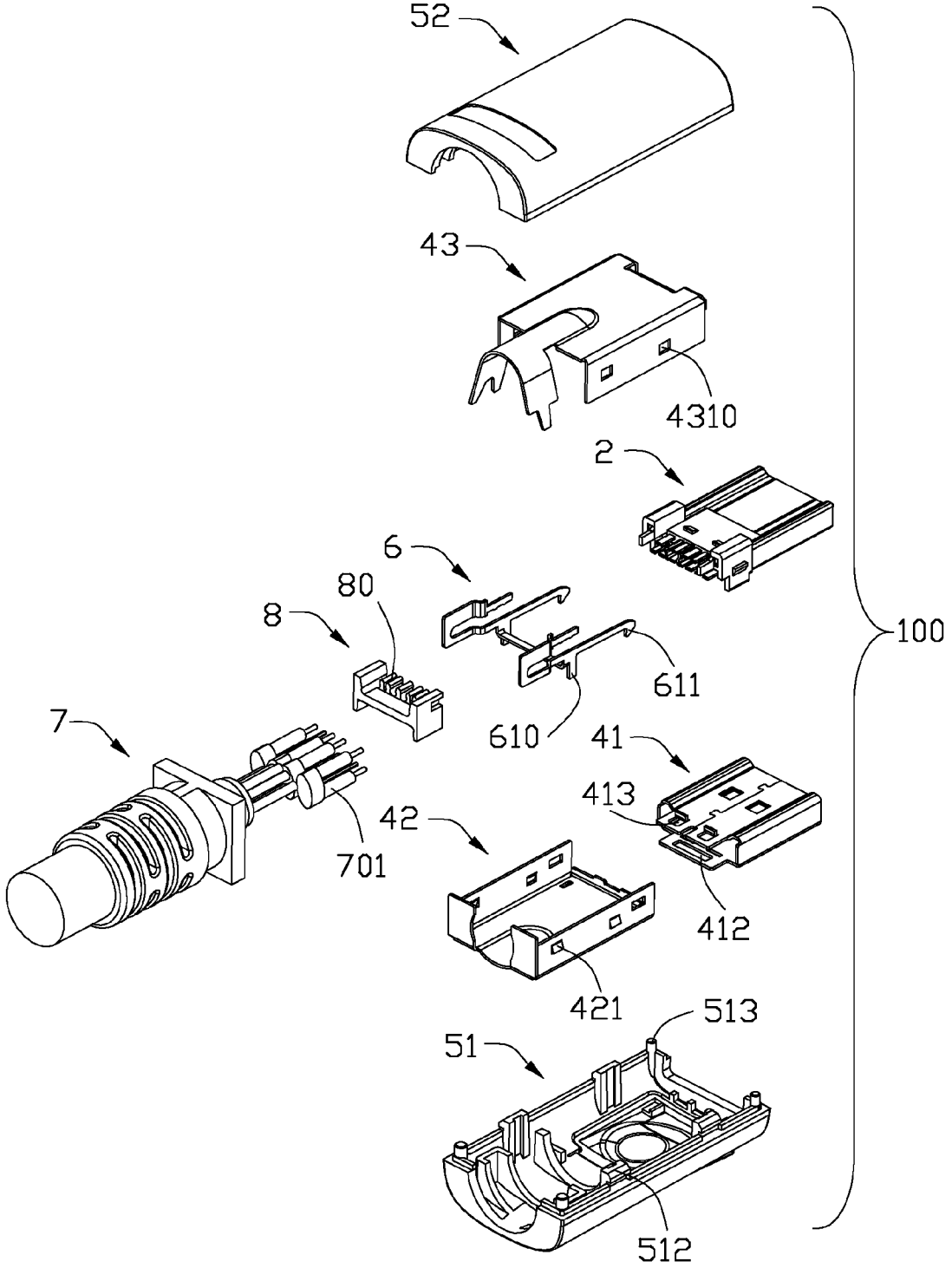
FIG. 3 is another exploded, perspective view of FIG. 2.
Figure 4:
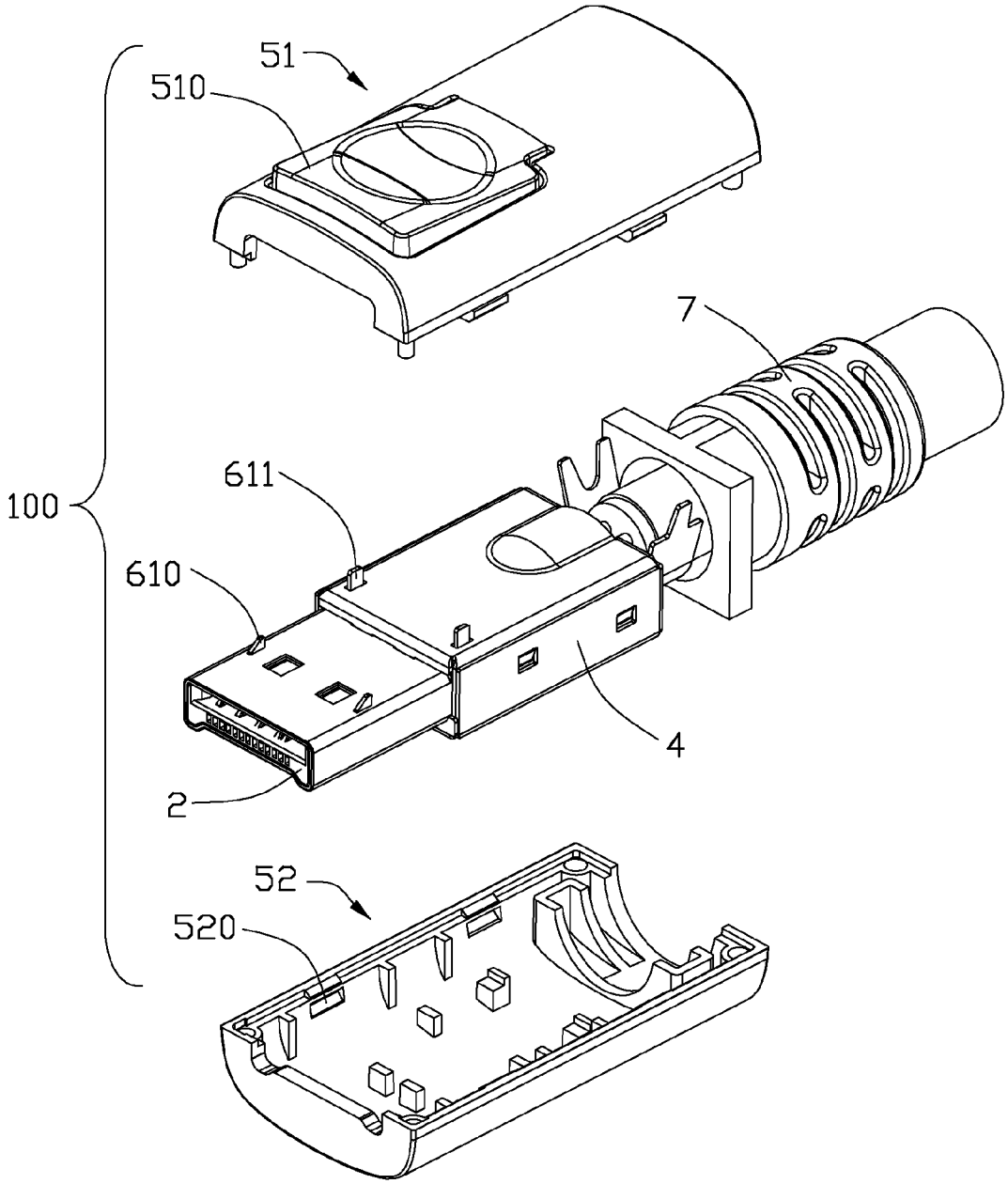
FIG. 4 is a partially assembled view of the cable assembly of FIG. 1.
Figure 5:
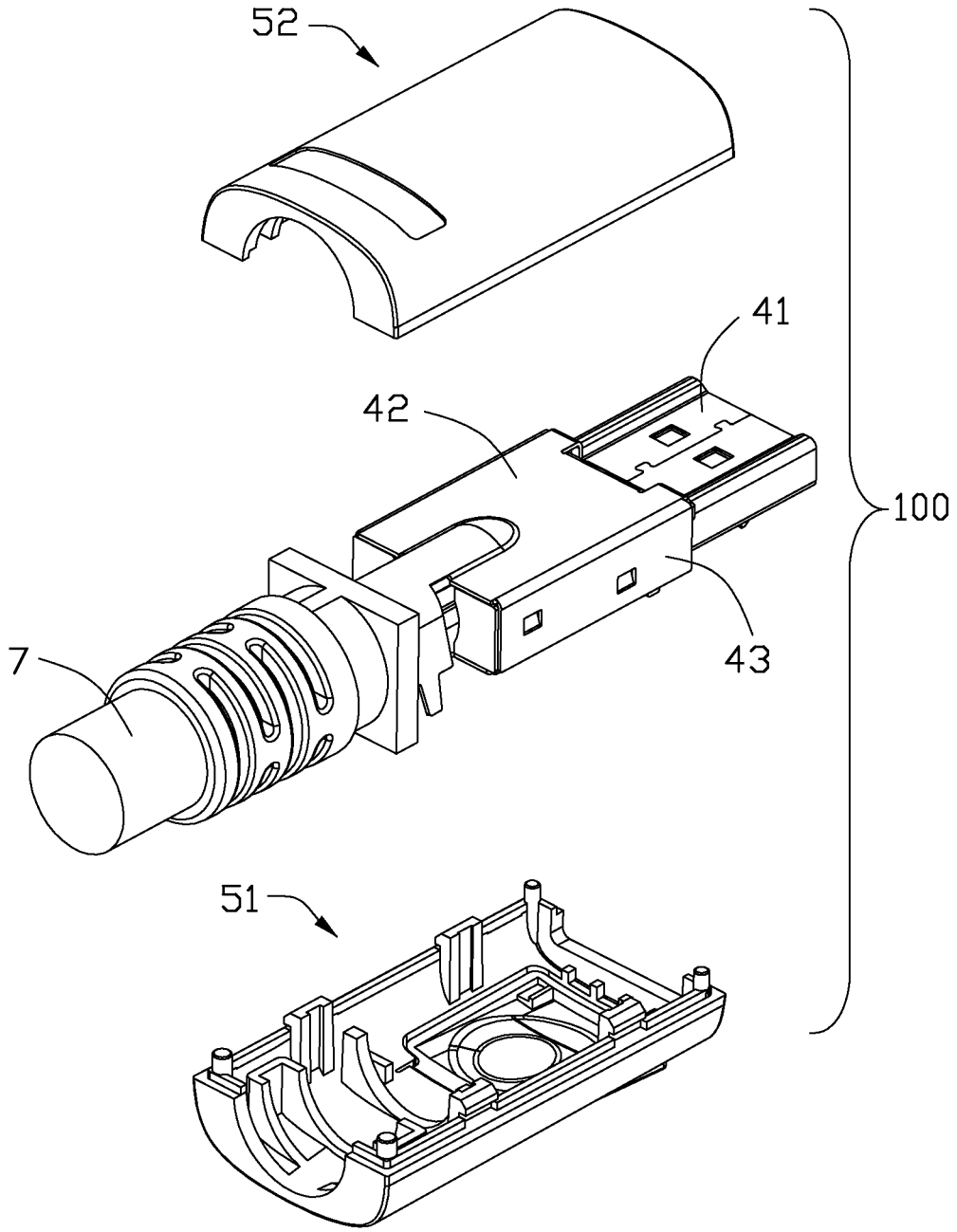
FIG. 5 is another partially assembled view of the cable assembly of FIG. 4.

Referring to FIGS. 1 to 2 and in conjunction with FIGS. 6 to 10, the insulative housing 2 comprises a main portion 20 and a pair of mounting arms 21 extending rearwardly from two lateral sides of the main portion 20. A depression 202 is defined on an upper surface of the main portion 20. A receiving cavity 203 is recessed forwardly from a middle segment of a rear surface of the main portion 20. The insulative housing 2 also has a plurality of passageways 204 communicated with the depression and the receiving cavity 203. Each of the mounting arms 21 defines a mounting hole 210 forwardly recessed from a rear end thereof. Each of the mounting arm 22 has a sliding slot 211 formed on an inner side surface thereof.

Figure 6:
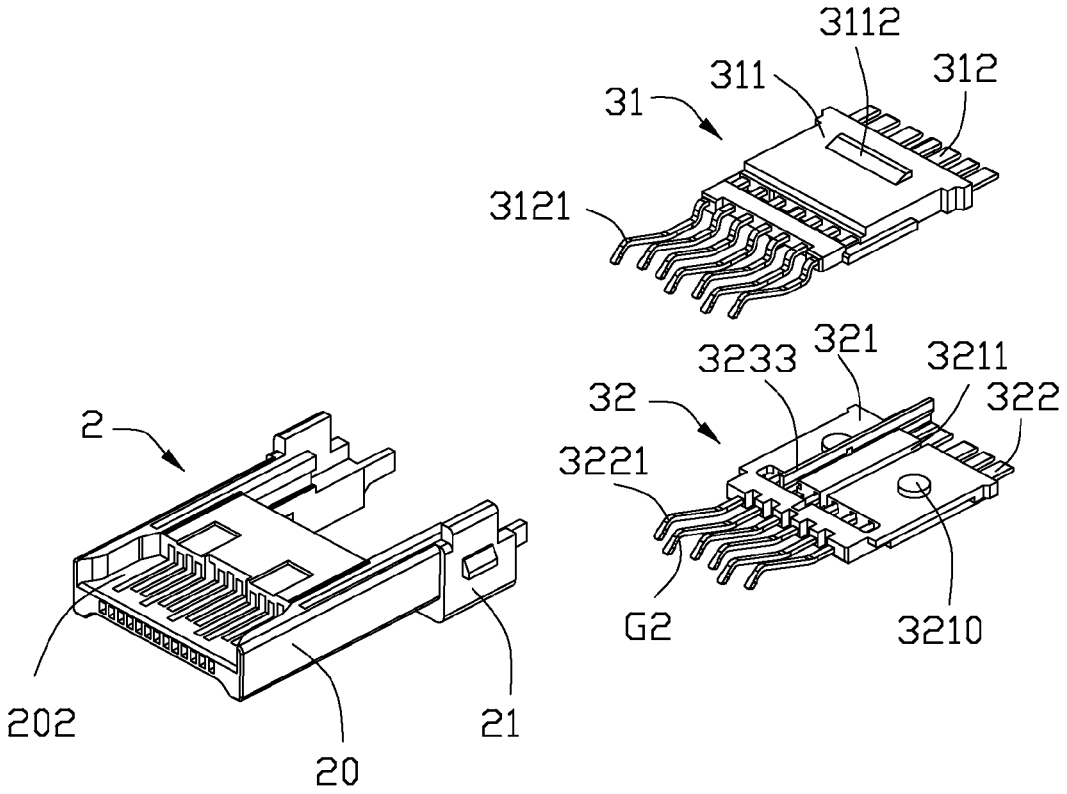
FIG. 6 is an exploded, perspective view of an insulative housing and two sub-terminal modules of the cable assembly shown in FIG. 1.
Figure 7:
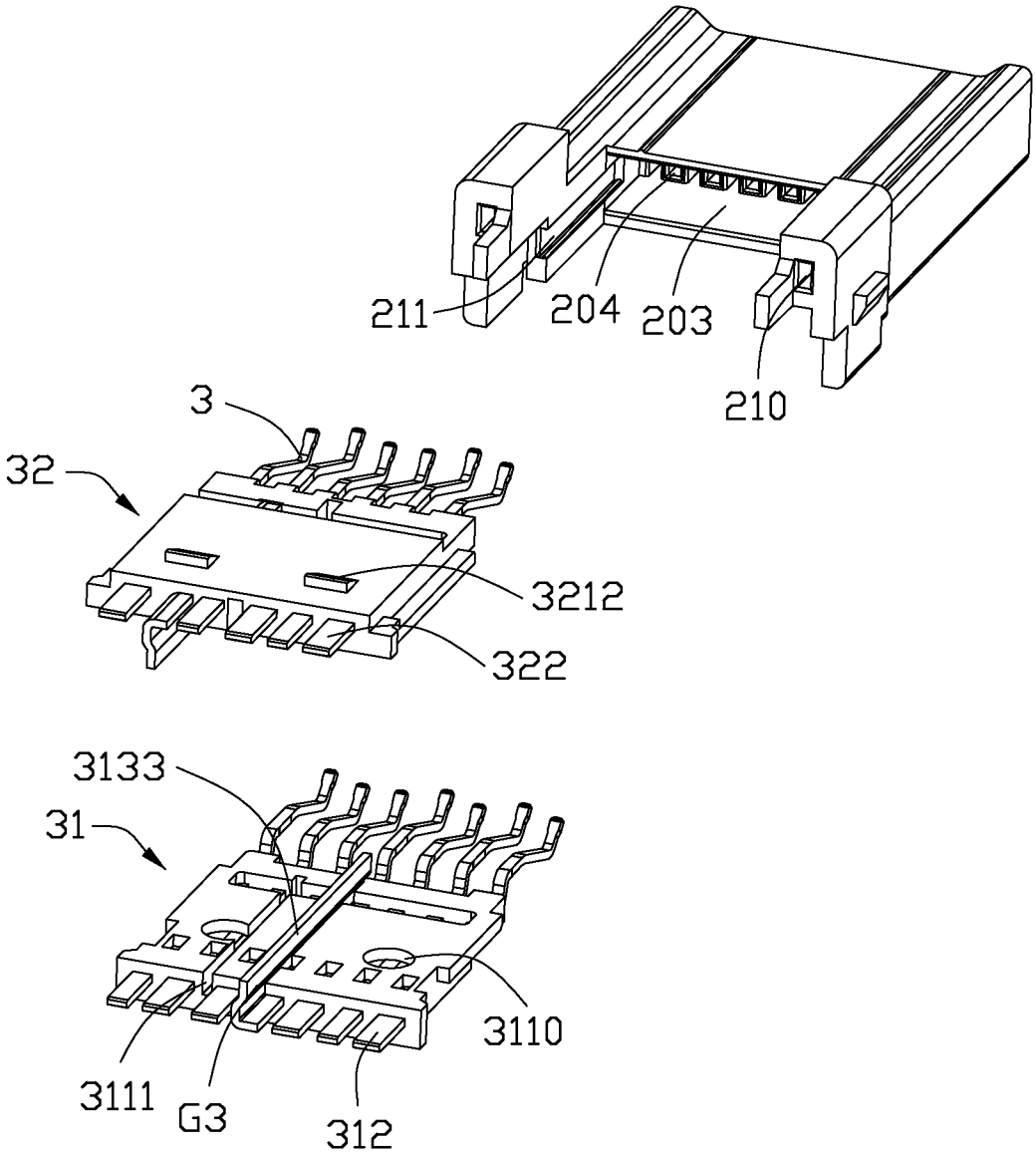
FIG. 7 is an another exploded, perspective view of FIG. 6.
Figure 8:
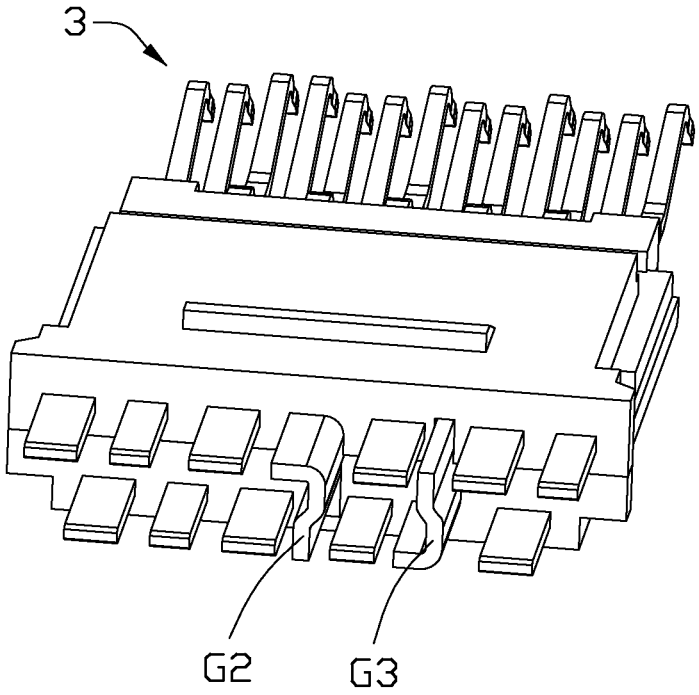
FIG. 8 is an assembled, perspective view of a terminal module formed by two sub-terminal modules shown in FIG. 7.
Figure 9:
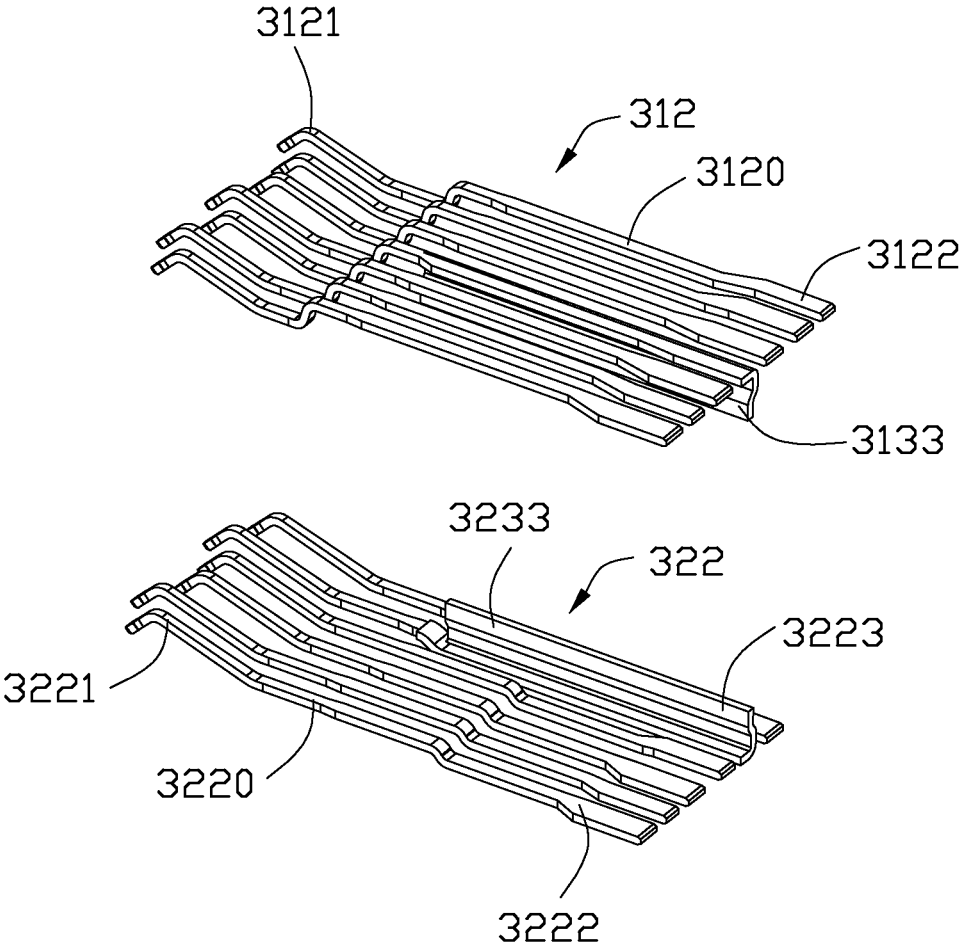
FIG. 9 is a perspective view of a plurality of terminals of the two sub-terminal modules shown in FIG. 6.
Figure 10:
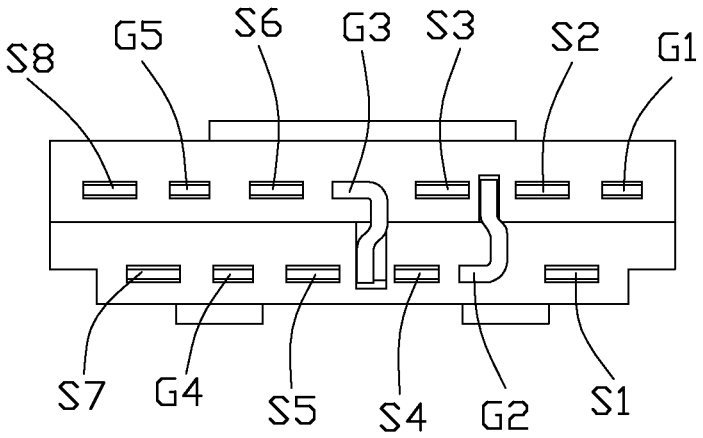
FIG. 10 is a rear view of FIG. 8.

Referring to FIGS. 6 to 8, the terminal module 3 comprises a first terminal unit 31 and a second terminal unit 32 assembled with each other along an up-to-down direction. The terminal module 3 comprises four pairs of differential signal terminals S1,S2; S3,S4; S5,S6; S7,S8 and five grounding terminals G1,G2,G3,G4,G5.

Referring to FIGS. 6 to 10, the first terminal unit 31 comprises a first insulator 311 and a plurality of first terminals 312 integrative formed with the first insulator through insert-molding process. Each of the first terminal 312 comprises a horizontal body portion 3120, a first curved mating portion 3121 forwardly extending beyond a front surface of the first insulator 311, and a soldering portion 3122 extending rearwardly beyond a rear surface of the first insulator 311. The plurality of first terminals 312 comprises four signal terminals S2, S3, S6, S8 and three grounding terminals G1, G3, G5. Each of grounding terminal G1, G3, G5 has a front end located in front of that of each of signal terminal S2, S3, S6, S8. The first terminals 312 are labeled as G1, S2, S3, G3, S6, G5, S8 in proper sequence along a transversal direction. The signal terminals S2, S3 are adjacent with each other without a grounding terminal intervened therebetween. One grounding terminal G3 further comprises an extending portion 3133 extending downwardly and inwardly from an edge of the body portion 3210 and the soldering portion 3122. The extending portion 3133 is generally located on a middle section of the soldering portion 3122 along a widthwise direction thereof. The first insulator 311 defines two positioning holes 3110 and wedge-shaped protrusion 3112 respectively formed on a bottom and top surfaces thereof. The first insulator 311 further defines a slit 3111 formed on a bottom surface thereof and extending from a front surface to a rear surface thereof. The slit 3111 is located between two signal terminals S2, S3 along a transversal direction. The extending portion 3133 extends beyond the bottom surface of the insulator 311 for a distance.

Referring to FIGS. 6 to 10, the second terminal unit 32 comprises a second insulator 321 and a plurality of second terminals 322 integrative formed with the second insulator 321 through insert-molding process. Each of second terminal 322 comprises a horizontal body portion 3220, a second curved mating portion 3221 forwardly extending beyond a front surface of the second insulator 321 and a soldering portion 3222 extending rearwardly beyond a rear surface of the second insulator 321. The plurality of second terminals 322 comprises four signal terminals S1, S4, S5, S7 and two grounding terminals G2, G4. Each of grounding terminal G2, G4 has a front end located in front of that of each of signal terminal S1, S4, S5, S7. The second terminals 322 are labeled as S1, G2, S4, S5, G4, S7 in proper sequence along a transversal direction. The signal terminals S4, S5 are adjacent with each other without a grounding terminal intervened therebetween. One grounding terminal G2 further comprises an extending portion 3233 extending upwardly and inwardly from an edge of the body portion 3220 and the soldering portion 3222. The extending portion 3233 is generally located on a middle section of the soldering portion 3222 along a widthwise direction thereof. The second insulator 321 defines two positioning posts 3210 and a slit 3211 formed on a top surface thereof. The two positioning posts 3210 are used for cooperating with two positioning holes 3110. The slit 3211 extends along a longitudinal direction from the front surface to the rear surface and is located between two signal terminals S4, S5 along a transversal direction. The extending portion 3233 extends beyond the top surface of the second insulator 321 for a distance. The second insulator 321 defines a pair of wedge-shaped protrusions 3212 formed on the bottom surface thereof.

Referring to FIGS. 6 to 10, the terminal module 3 is formed after the first and second terminal units 31, 32 assembled with each other. The terminal module 3 comprises a plurality of first and second terminals 312, 322. The first and second mating portions 3121, 3221 of the first and second terminals 312, 322 are arranged into a row along a transversal direction. The first body portions 3210 and soldering portions 3122 of the first terminals 312 are located in an upper row. The second body portions 3220 and soldering portions 3222 of the second terminals 322 are located in a lower row. Obviously, body portions 3120, 3220 and soldering portions 3122, 3222 of each pair of differential signal terminals S1,S2; S3,S4; S5,S6; S7,S8 are located on different rows. The extending portion 3133 of the grounding terminal G3 is received into the slit 3211 to space the body portions 3210 and the soldering portions 3122 of the two signal terminals S4, S5. And, the extending portion 3223 of the grounding terminal G2 is received into the slit 3111 to space body portions 3210 and the soldering portions 3122 of the two signal terminals S2, S3. Thus, the body portions 3210 and the soldering portions 3122 of the two pairs of differential signal terminals S1,S2; S3,S4 are also totally spaced apart the grounding terminal G2 along a transversal direction. The body portions 3210 and the soldering portions 3122 of the two pairs of differential signal terminals S3,S4; S5,S6 are also totally spaced apart the grounding terminal G3 along a transversal direction. And, two adjacent pairs of differential signal terminals S5,S6; S7,S8 are also spaced apart by the grounding terminals G4,G5 respectively in an upper and lower row. So, signal transmission between two adjacent pairs of differential signal terminals will be stability and not be affected to each other. As a result, near-end crosstalk (NEXT) will be avoided during signal transmission of the cable assembly 100.

Referring to FIGS. 2 to 5, the cable assembly 100 further comprises a latching member 6 assembled to the housing 2 along a rear-to-front direction. The latching member 6 comprises a pair of latches spaced apart from each other along the left-to-right direction, a connecting bridge 63 connected with the pair of latches. Each latch comprises a U-shaped connecting portion 60, a latching arm 61 extending forwardly from a top side of the U-shaped connecting portion 60, and a mounting portion 62 extending forwardly from a bottom side of the U-shaped connecting portion 60. The latching arm 61 defines a retention portion 610 formed on a rear end thereof, a hook 611 disposed at a front end thereof. The pair of latching arms 61 are received into the two mounting holes 210 of the housing 2. The mounting portions 62 are received into the sliding slot 211 to achieve an engagement between the latching member 6 and the housing 2.

Referring to FIGS. 2 to 5, the metallic shell 4 comprises a front shell 41, a reversed U-shaped top shell 42 engaged with a top side of the front shell 41, and a U-shaped bottom shell 43 engaged the top shell 42. The front shell 41 is structured in a framed shape. The front shell 41 defines a pair of openings 410 for a pair of hooks 611 of the latching member 6 passing through, a pair of apertures 411 located behind the pair of opening 410, and a latching hole 412 formed on a top wall thereof. The latching hole 412 of the front shell 41 is used for cooperating with the protrusion 3112 of the terminal module 3. The top shell 42 defines a plurality of tabs 421 formed at two sides thereof and two protruding portions 422 formed at a front side thereof and cooperated with the pair of apertures 411. The bottom shell 43 comprises a main portion 431 and a crimping portion 432 extending rearwardly from the main portion 431. The main portion 431 defines a plurality of openings 4310 cooperated with the tabs 421 of the top shell 42.

Referring to FIGS. 2 to 5, the insulative cover comprises a top cover 51 and a bottom cover 52. The top cover 51 defines a button 511 formed on a top surface thereof, four locking members 512 formed at two sides thereof, and four positioning posts 521. The bottom cover 52 defines four grooves 520 cooperated with the four locking members 512 and four holes 521 cooperated with the four positioning posts 521.

Referring to FIGS. 1 to 5, the cable set 7 comprises a cable 70 and a strain relief 71 formed around the cable 70. The cable 70 comprises a plurality of conductive wires 701 electrically connected to the plurality of terminals 312, 322.

The cable assembly 100 further comprises a wire management assembled to a rear end of the housing 2. The wire management 8 defines a plurality of receiving slots 80. The plurality of conductive wires 701 are passed through the corresponding receiving slots 80 and electrically connected to the first and second terminals 312, 322.

As two adjacent pairs of differential signal terminals are intervened with a grounding terminal, so signal transmission between two adjacent pairs of differential signal terminals will be stability. And, near-end crosstalk (NEXT) will be obviously improved during signal transmission of the cable assembly.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly comprising: an insulative housing; a plurality of terminals assembled to the insulative housing, the plurality of terminals comprising several pairs of differential signal terminals and at least one grounding terminal intervened between each of two adjacent pairs of differential signal terminals along a transversal direction, each of terminal defining a front mating portion, a rear soldering portion and a body portion connecting with the mating portion and the soldering portion, the front mating portions of the plurality of terminals located on a row, the body portions and rear soldering portions of the plurality of terminals respectively located on two rows along an up-to-down direction, and body portions and rear soldering portions of each differential signal terminals located on two upper and lower rows; wherein there is only one grounding terminal intervened between two adjacent pairs of differential signal terminals, the grounding terminal defines an extending portion extending along a vertical direction to totally spaced apart the body portions and rear soldering portions of two adjacent pairs of differential signal terminals respectively located on two upper and lower rows along a transversal direction, wherein the cable assembly further comprises a metallic shell shielding the housing, an insulative cover surrounding the metallic shell, wherein the cable assembly further comprising a cable electrically connected to the soldering portions of the plurality of terminals.

2. The cable assembly as recited in claim 1, wherein the extending portion extends from one edge of the body portion and the rear soldering portion of the grounding terminal.

3. The cable assembly as recited in claim 1, wherein there are two grounding terminals intervened between two adjacent pairs of differential signal terminals, two body portions and soldering portions of the two grounding terminals are located on two rows for respectively spacing apart the body portions and soldering portions of the two adjacent pairs of differential signal terminals located on the two rows.

4. The cable assembly as recited in claim 1, wherein the insulative housing defines a depression formed on a top surface thereof, and the mating portions of the plurality of terminals are located in the depression.

5. A cable assembly comprising: an insulative housing; a terminal module assembled to a rear end of the insulative housing, the terminal module comprising a plurality of pairs of differential signal terminals and a plurality of grounding terminals arranged long a widthwise direction thereof, each of terminal defining a mating portion, a body portion and a soldering portion, mating portions of the signal and grounding terminals located on a row, body portions and soldering portions of the signal and grounding terminals located on two rows; wherein there are at least one grounding terminal intervened between two pairs of differential signal terminals to totally space apart the body portions and soldering portions of two adjacent pairs of differential signal terminals located on two rows, wherein the terminal module comprises a first terminal unit and a second terminal unit stacked with each other, the first and second terminal units respectively comprising a first and second insulators and a plurality of signal and grounding terminals integrative formed with the first and second insulators, wherein an extending portion of the grounding terminal formed in the first terminal unit is inserted into the second insulator of the second terminal unit.

6. The cable assembly as recited in claim 5, wherein there are two grounding terminals with two body portions and soldering portions located on different rows respectively to space apart the body portions and soldering portions of two adjacent pairs of differential signal terminals located on two rows.

7. The cable assembly as claimed in claim 5, wherein there is one grounding terminal with an extending portion extending from one row to another row along an up-to-down direction to totally space apart the body portions and soldering portions of two adjacent pairs of differential signal terminals located on two rows.

8. The cable assembly as recited in claim 5, wherein the extending portion of the grounding terminal formed in the second terminal unit is inserted into the first insulator of the first terminal unit.

9. The cable assembly as recited in claim 7, wherein the extending portion extends from an edge of the grounding terminal.

10. An electrical connector comprising: an insulative housing defining a front mating port and a rear connecting port in a front-to-back direction; a first row of contacts and a second row of contacts disposed in the housing and spaced from each other in a vertical direction perpendicular to said front-to-back direction while each row extending along a transverse direction perpendicular to both said front-to-back direction and said vertical direction, each of said contacts defining a front contacting section exposed in the mating port, a rear connecting section exposed in the connecting port and a retention section therebetween in the front-to-back direction, both said first row of contacts and said second row of contacts being categorized with at least two differential pairs and one grounding terminal located between said two differential pairs in the transverse direction; the connecting sections of each pair of said two differential pairs being located in said first row and said second row, respectively; wherein the retention section of each of said two differential pairs essentially extends in a planar manner with generally a constant cross-section in a side view while said grounding terminal further extends in roughly said vertical direction to form an extending portion linked with one side edge of the corresponding retention section and spanning between two rows so as to form shielding to efficiently isolate the retention portions of said two differential pairs from each other in said transverse direction, further including another differential pair neighboring one of said two differential pairs with another grounding terminal therebetween, wherein said another grounding terminal includes an extending portion linked with the corresponding retention section and spanning between said two rows in the vertical direction, wherein the connecting section of the grounding terminal and that of said another grounding terminal are located at said first row and said second row, respectively, wherein the connecting sections of said another differential and the grounding terminals and those of the neighboring differential pairs are arranged in a W-like configuration viewed in the front-to-back direction.

11. The electrical connector as claimed in claim 10, wherein the rear connecting sections of both said grounding terminals and said differential pairs are arranged in said two rows and extend in two imaginary horizontal planes defined by said transverse direction and said front-to-back direction.

12. The electrical connector as claimed in claim 10, wherein the extending portion further isolates the connecting portions of one of said two differential pairs from those of the other in said transverse direction.

13. The electrical connector as claimed in claim 10, wherein said extending portion defines an offset section in the transverse direction around a middle line between said first and second rows so as to comply with a staggered arrangement among the connecting sections of both said differential pairs and said grounding terminals.

* * * * *